US006573641B2

(12) United States Patent
Matsutani

(10) Patent No.: US 6,573,641 B2
(45) Date of Patent: Jun. 3, 2003

(54) SPARK PLUG

(75) Inventor: Wataru Matsutani, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 177 days.

(21) Appl. No.: 09/793,504

(22) Filed: Feb. 27, 2001

(65) Prior Publication Data

US 2001/0022492 A1 Sep. 20, 2001

(30) Foreign Application Priority Data

Feb. 29, 2000 (JP) ..... 2000-055003

(51) Int. Cl.[7] ..... H01T 13/20; F02P 1/00

(52) U.S. Cl. ..... 313/141; 313/142; 123/169 R; 123/169 EL

(58) Field of Search ..... 313/311, 141, 313/142, 124; 123/169 R, 169 EL

(56) References Cited

U.S. PATENT DOCUMENTS 6,094,000 A 7/2000 Osamura et al. ..... 313/141
6,147,441 A 11/2000 Osamura ..... 313/141
6,166,480 A * 12/2000 Ishida et al. ..... 313/141
6,307,307 B1 * 10/2001 Kanao ..... 313/142

FOREIGN PATENT DOCUMENTS

JP 9-7733 1/1997 ..... H01T/13/20
JP 9-219274 8/1997 ..... H01T/13/20

* cited by examiner

*Primary Examiner*—Sandra O'Shea
*Assistant Examiner*—Pete Macchiarolo
(74) *Attorney, Agent, or Firm*—Sughrue Mion, PLLC

(57) ABSTRACT

A spark plug is provided which comprises a center electrode and a ground electrode having at a free end portion thereof a discharge surface which is opposite to an axial end surface of the center electrode to provide therebetween a spark gap, wherein the center electrode has a center electrode tip forming the axial end surface thereof, the center electrode tip being made of a material containing Ir as a major constituent, and wherein $G \leqq 2A+0.5$ where G is a spark gap (mm) and A is the distance (mm) between a first imaginary line and a second marginal line.

14 Claims, 4 Drawing Sheets

SPARK PLUG

BACKGROUND OF THE INVENTION

The present invention relates to a spark plug for internal combustion engines.

A long period of usage of a spark plug causes a center electrode and a ground electrode thereof to be damaged by a fire and consumed, thus increasing the spark gap. By this, there may possibly be caused such a case in which a required voltage necessary for producing a spark discharge across the spark gap becomes higher and exceeds a maximum capacity of an ignition system or a spark is not produced across the normal spark gap but across to an end surface of the ground electrode or an end surface of a metallic shell. As a result, the spark plug is disabled to ignite a combustible mixture assuredly, leading to a deterioration of the durability of the spark plug itself.

For this reason, in the prior art spark plug, a center electrode tip made of Pt or a Pt alloy is attached to the axial end of the center electrode to suppress enlargement of the spark gap. In the meantime, the melting point of Pt is about 1800° C. After the spark plug having the center electrode tip made of Pt or a Pt alloy is used for a long period, the surface of the center electrode tip is partially melted to cause a granular deposit thereon, and the deposit keeps growing. Such a granular deposit on the surface of the center electrode tip is effective for suppressing enlargement of the spark gap for thereby preventing increase of the discharge voltage and occurrence of a side spark phenomenon (i.e., a phenomenon causing a spark not across a normal spark gap but an abnormal gap). However, since the melting point of the tip made of Pt or a Pt alloy is a little low, the tip encounters a problem that it is damaged by a spark and therefore the electrode consumption suppressing effect is limited to some extent.

Thus, for the purpose of attaining a more efficient electrode consumption suppressing effect than that in the case the tip made of Pt or a Pt alloy is used, it has been proposed a spark plug having a center electrode tip made of Ir or an Ir alloy as disclosed in Japanese Patent Provisional Publication No. 9-219274. Since the melting point of Ir is about 2400° C. and therefore higher as compared with that of Pt, the tip made of Ir can attain a better durability and is more efficient for preventing itself from being damaged by a spark as compared with that made of Pt, thus making it possible to elongate the life of the spark plug.

SUMMARY OF THE INVENTION

Since the melting point of Ir is higher than that of Pt, the tip made of Ir can effectively be prevented from being damaged by a spark and therefore can attain an improved durability. However, a granular deposit is hardly formed on the surface of the tip. In this connection, in the spark plug having a center electrode tip made of Ir, there is not caused any problem if the center electrode tip is accurately aligned with the ground electrode. However, a certain misalignment may possibly occur in manufacture. If there is such a misalignment, the granular deposit is formed in case of the Pt tip to suppress enlargement of the spark gap and therefore the discharge voltage is stabilized to jump properly across the spark gap to produce a spark. However, in case of the Ir tip, the granular deposit is not formed, thus causing the discharge voltage to tend to rise and making higher the frequency at which a side spark jumping across to the end surface of the metallic shell or the like is caused. As a result, ignition of the combustible mixture is prevented, and the unburned gases are emitted, thus decreasing the efficiency of the engine and badly affecting the environment by the emission of the exhaust gases.

It is accordingly an object of the present invention to provide a spark plug which has a long life and can prevent a side spark phenomenon and a variation of discharge voltage for thereby improving the ignitability and preventing emission of unburned gases.

To accomplish the above object, the present invention provides a spark plug comprising a metallic shell having an externally threaded portion, an insulator disposed within the metallic shell and having an axial through hole, a center electrode disposed within the axial through hole of the insulator, and a ground electrode having a joining end portion joined to the metallic shell and a free end portion having a discharge surface which is opposite to an axial end surface of the center electrode to provide therebetween a spark gap, wherein the center electrode has a center electrode tip forming the axial end surface thereof, the center electrode tip being made of a material containing Ir as a major constituent, and wherein $G \leqq 2A+0.5$ where G is the spark gap in millimeter(s) and A is the distance in millimeter (s) between a first imaginary line and a second marginal line, the first imaginary line being parallel to an imaginary axis of the spark plug and in a position where it touches a first marginal line for the first time when moved toward the spark gap from a side of the spark gap opposite to the joining end portion along a plane including the imaginary axis and crossing the second marginal line at right angles, the imaginary axis being determined on the basis of an axis of the externally threaded portion, the first marginal line being formed by an axial end surface and a side surface of the center electrode tip, the second marginal line being formed by the discharge surface of the ground electrode and an end surface of the free end portion of the ground electrode.

In case of the spark plug of the type shown in FIG. 3, the above described spark gap represents a minimum distance between the axial end surface of the center electrode tip and the discharge surface of the ground electrode (or the discharge surface of the ground electrode tip in case the ground electrode is provided with the ground electrode tip). However, in case of the spark plug of the type shown in FIG. 6, i.e., of the type wherein the center electrode tip has a tapered portion, the spark gap represents a minimum distance between the tapered portion and the discharge surface of the ground electrode or the ground electrode tip. The spark gap G is usually within the range from 0.7 to 1.5 mm, preferably from 0.7 to 1.3 mm and more preferably from 0.85 to 1.1 mm. It is desirable to set the spark gap G within such a range since by so setting, a bridge across the spark gap due to fuel is hard to be caused, the ignitability is never deteriorated and excessive electrode consumption is never caused.

The above described first marginal line is formed by the axial end surface and the side surface of the center electrode tip. The first marginal line corresponds to an edge of the center electrode tip where there may possibly exist a burr or burrs. In such a case, the burr or burrs are first removed from the edge and then consideration of the first marginal line is made. In the meantime, the side surface of the center electrode tip, which forms the first marginal line, is, for example, cylindrical.

The above described second marginal line is formed by the discharge surface and the end surface of the ground electrode. The ground electrode is formed by cutting a coiled wire of a rectangular cross section, and the end surface of the ground electrode corresponds to a cut surface of the wire. For this reason, there may occur such a case in which the end surface of the ground electrode is not flat but stepped. In such a case, the second marginal line is determined on the basis of an end surface portion of the ground electrode located nearer to the discharge surface. The above describe distance A can be measured by the use of a projector.

In the spark plug of this invention, by determining the spark gap G (mm) and the distance A (mm) so as to satisfy $G \leqq 2A+0.5$, suppression of electrode consumption due to spark discharge which is an advantage in case the center electrode tip made of Ir or Ir alloy is used at the end portion of the center electrode for forming the spark gap can be attained. As a result, it becomes possible to elongate the life of the spark plug and at the same time it becomes possible to prevent or suppress occurrence of a side spark phenomenon and a variation of discharge voltage which are apprehensions caused when the center electrode tip made of a material containing Ir as a major constituent is used. In the meantime, "a material containing Ir as a major constituent" is intended to indicate that, of the constituents of the material, the weight percentage content of Ir is largest but not intended to indicate that the Ir content is equal to or larger than 50 wt %.

The discharge surface of the ground electrode may be provided with a ground electrode tip to form the spark gap for the purpose of suppressing consumption of the ground electrode. In case the ground electrode tip is provided, the distance B between the second marginal line and a second imaginary line is determined so as to be equal to or larger than 0.22 mm, preferably 0.3 mm or larger and more preferably 0.35 to 0.8 mm (refer to FIG. 3), where the second imaginary line is parallel to the second marginal line and in a position where it touches the ground electrode tip for the first time when moved along the discharge surface toward the ground electrode tip from a side of the ground electrode tip opposite to the joining end portion of the ground electrode, namely, the second imaginary line is parallel to the second marginal line, located on the discharge surface of the ground electrode and on a side of the ground electrode tip nearer to the end surface of the ground electrode and touching the ground electrode tip. The distance B smaller than 0.2 mm is not desirable since the ground electrode tip has a possibility of being separated from the ground electrode due to heat to which it is subjected. In the meantime, in case the ground electrode tip is attached to the discharge surface by welding, there may occur such a case in which a fused alloy portion consisting of the constituents of the ground electrode tip and the constituents of the ground electrode is formed around the joint between the ground electrode tip and the ground electrode. In such a case, the first marginal line is determined without consideration of such a fused alloy portion but on the basis of the ground electrode tip itself.

When the ground electrode tip is disposed so to be at least partially overlain by the center electrode tip, it becomes possible to prevent or suppress abnormal consumption of the discharge surface of the ground electrode due to spark discharge for thereby elongating the life of the spark plug. In the meantime, the ground electrode tip can be made of a material containing Ir as a major constituent similarly to the center electrode tip or a Pt alloy such as Pt—Ni and Pt—Ir.

The center electrode tip can be made of Ir or Ir alloy. There is no limitation on the Ir alloy so long as the weight percentage content of Ir is highest. However, it is preferable to make the center electrode tip of Ir—Pt, Ir—Rh or Ir—$Y_2O_3$ since such a tip makes it possible to prevent or suppress oxidation-volatilization of the center electrode tip at the more severe temperature for thereby suppressing electrode consumption. Further, in case the center electrode tip is made of an Ir alloy, it is preferable from the electrode consumption preventing point of view that the solidus line in the equilibrium state diagram of the Ir alloy is equal to or higher than 1900° C.

The diameter of the center electrode tip is set so as to range from 0.3 to 1.0 mm and more preferably 0.4 to 0.8 mm. In case the diameter of the center electrode tip is smaller than 0.3 mm, the volume of the tip and the surface for forming the spark gap are too small even if the tip is made of Ir or Ir alloy which is a high melting point material, thus causing the center electrode tip to become not so effective of suppressing electrode consumption due to spark discharge. Accordingly, the diameter of the center electrode tip of smaller than 0.3 mm is not desirable. On the other hand, in case the diameter of the center electrode tip exceeds 1.0 mm, the surface of the tip for forming the spark gap is so large unless the spark plug with such a center electrode tip is used for particular purpose, thus causing the heat of a spark produced at the spark gap to be absorbed by the surface of the tip (i.e., a fire extinguishing phenomenon) and causing a possibility of a misfire. Thus, the diameter of the tip larger than 1.0 mm is not desirable.

DESCRIPTION OF THE PREFERRED EMBODIMETNS

Figure 1:
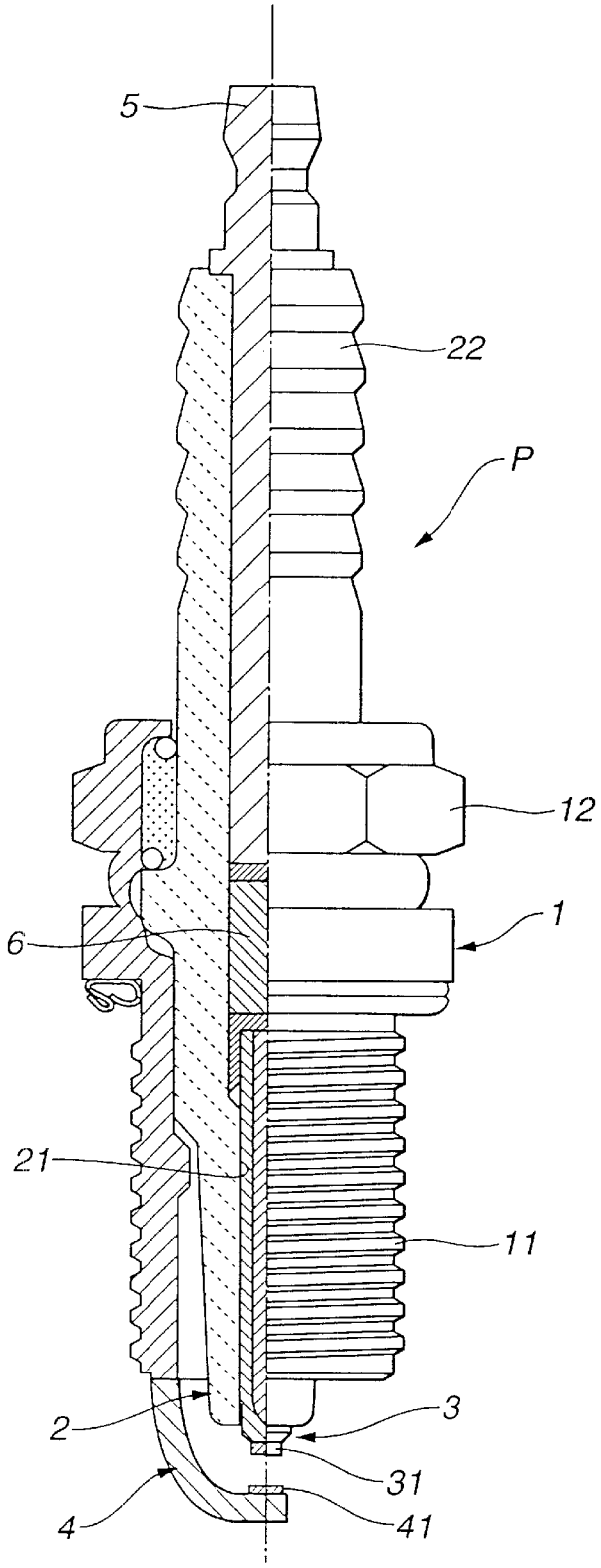
FIG. 1 is a partly cutaway elevational view of a spark plug according to an embodiment of the present invention.
Figure 2:
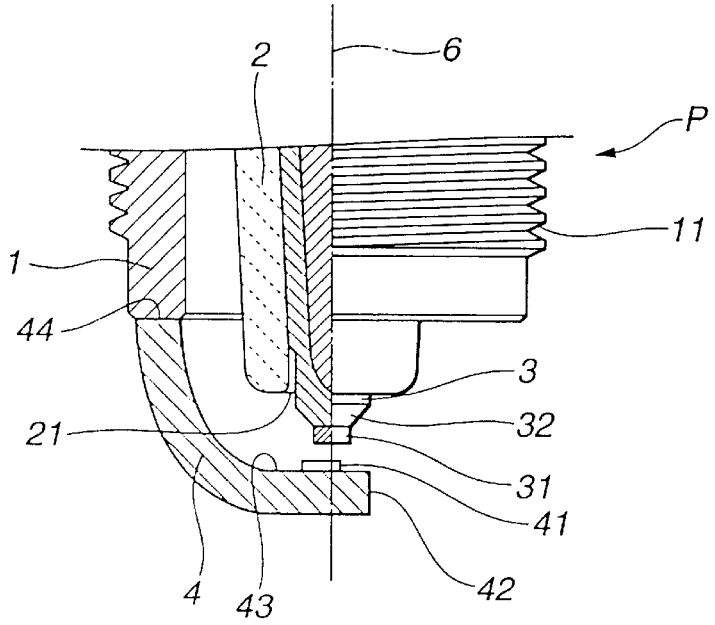
FIG. 2 is an enlarged, partly cutaway, fragmentary elevational view of the spark plug of FIG. 1.

Referring first to FIGS. 1 to 4, a spark plug according to an embodiment of the present invention is generally indicated by P and includes a metallic shell 1, an insulator 2 surrounded by the metallic shell 1 and having a concentric axial through hole 21, a center electrode 3 disposed in the axial through hole 21 and a ground electrode 4 having a joining end portion 44 at which it is connected to an axial end of the metallic shell 1.

The metallic shell 1 is made of a low carbon steel and has on an outer circumferential surface thereof an externally threaded portion 11 (nominal designation of thread is M14S and reach is 19 mm) for attachment of the spark plug P to an internal combustion engine (not shown). The metallic shell 1 also has a hexagonal portion 12 with which a spark plug box spanner (not shown) is engaged. The insulator 2 is formed from a sintered ceramic body whose major constituent is alumina. The insulator 2 is 60 mm in the overall length, 5.1 mm in the outer diameter at an axial end located adjacent a place where a spark is produced, and 2.8 mm in the diameter of the axial through hole 21. The insulator 2 is disposed within the metallic shell 1 so as to have an axial end portion which protrudes from the axial end of the metallic shell 1 by 1.5 mm. The insulator 2 has a corrugated axial end portion 22 which is opposite to the protruded axial end portion.

Figure 3:
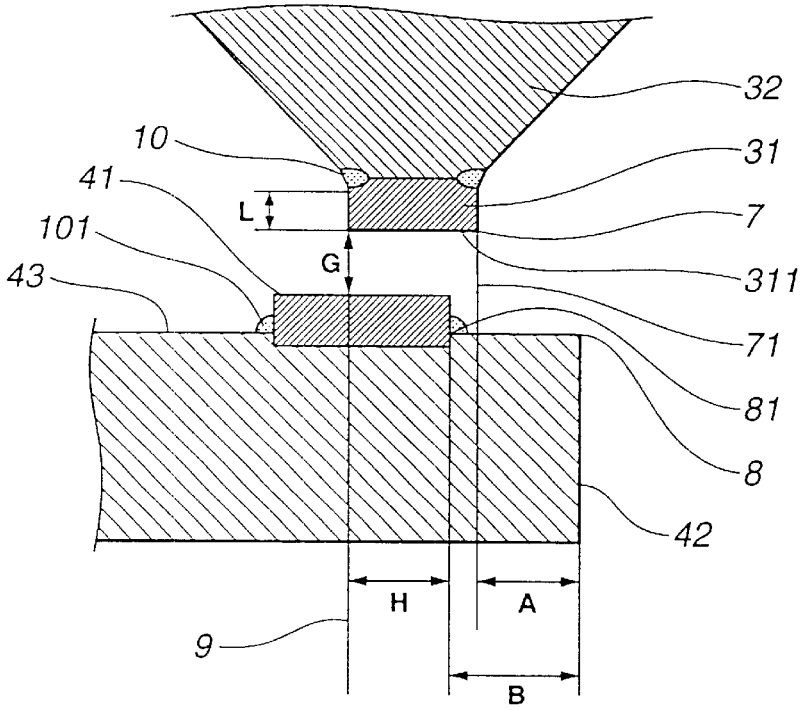
FIG. 3 is an enlarged sectional view of a principal portion of the spark plug of FIG. 1.

The center electrode 3 is made of a nickel alloy such as Inconel 600 (trade name) and has inside thereof a high heat conductive metal such as Cu or pure nickel or a composite material of Cu and pure nickel. The protruded axial end portion of the center electrode 3, which protrudes from the insulator 2, has a truncated cone-shaped portion 32 (0.3 mm in the length and 1.0 mm in the smaller diameter) which tapers toward the axial end of the center electrode 3 and a center electrode tip 31 welded to an axial end of the truncated cone-shaped portion 32. The center electrode tip 31 is made of an Ir-5 wt % Pt alloy and 0.6 mm in thickness and 0.8 mm in diameter. As shown in FIG. 3, the center electrode tip 31 is placed on an axial end surface of the truncated cone-shaped portion 32 and joined thereto by laser welding in such a manner as to partly remain as a cylindrical portion L of the length of 0.2 mm or more and partly form a fused alloy portion 10. Further, the center electrode 3 is electrically connected to a terminal 5 by way of a ceramic resistor 6 disposed in the through hole 21. To the terminal 5 is connected a high-tension cable (not shown) for applying thereto a high voltage.

The ground electrode 4 is made of a Ni alloy and welded at the joining end 44 to the axial end of the metallic shell 1. The ground electrode 4 has a free end portion opposite to the joining end portion 44. The free end portion of the ground electrode 4 has a discharge surface 43 opposite to the center electrode tip 31 and an end surface 42. The ground electrode 4 may have inside thereof a high heat conductive metal such as Cu or pure nickel or a composite material of Cu and pure nickel. The discharge surface 43 of the ground electrode 4 has joined thereto by resistance welding a ground electrode tip 41 which is at least partially overlain by the ground electrode tip 41 when viewed in plan. Between the center electrode tip 31 and the ground electrode tip 41 is formed a spark gap G. The ground electrode tip 41 is made of a noble metal such as an Ir alloy or a Pt alloy (in this embodiment, Pt—Ni alloy) and 0.3 mm in the thickness and 0.8 mm in the diameter.

In this instance, the ground electrode tip 41 of the ground electrode 4 is disposed so as to be at least partially overlain by the center electrode tip 31 as described above and in addition so as to meet the following positional relationship or requirement. Namely, as shown in FIG. 3, assuming that B is a distance between a second marginal line 8 and a second imaginary line 81, the ground electrode tip 41 is disposed so that the distance B is equal to or smaller than 0.2 mm. In this connection, the second marginal line 8 is a line formed by intersection of the discharge surface 43 and the end surface 42 of the ground electrode 4. The second imaginary line 81 is parallel to the second marginal line 8 and in a position where it touches the ground electrode tip 41 for the first time when moved along the discharge surface 43 toward the ground electrode tip 41 from a side of the ground electrode tip 41 opposite to the joining end portion 44 of the ground electrode 4. Namely, the second imaginary line 81 is parallel to the second marginal line 8, located on the discharge surface 43 of the ground electrode 43 and on a side of the ground electrode tip 41 opposite to the joining end portion 44 of the ground electrode 4 and touches the ground electrode tip 41. Since FIG. 3 is a cross sectional view of the spark plug P, the second marginal line 8 and the second imaginary line 81 are shown in FIG. 3 as points and actually extends perpendicularly to the surface of the drawing.

Further, in the spark plug P of this embodiment, as shown in FIG. 3, assuming that A is the distance between a first imaginary line 71 and the second marginal line 8, the distance A (mm) and the spark gap G (mm) are determined so as to satisfy $G \leqq 2A+0.5$. The first imaginary line 71 is parallel to an imaginary axis 6 of the spark plug P and in a position where it touches a first marginal line 7 for the first time when moved toward the spark gap G from a side of the spark gap G opposite to the joining end portion 44 of the ground electrode 4 along a plane including the imaginary axis 6 and crossing the second marginal line 8 at right angles. The imaginary axis 6 of the spark plug P is determined on the basis of an axis of the externally threaded portion 11 of the metallic shell 1. The first marginal line 7 is formed by a side surface (a cylindrical surface in this embodiment) and an end surface 311 of the center electrode tip 31. In other words, the first imaginary line 71 is parallel to the imaginary axis 6, located on a plane including the imaginary axis 6 and crossing the second marginal line 8 at right angles and on a side of the center electrode tip 31 opposite to the joining end portion 44 of the ground electrode 4, and touches the first marginal line 7. Though the first marginal line 7 is shown as a point in FIG. 3, it actually extends from this side of the drawing to the other side.

In the meantime, H in FIG. 3 is the distance between a third imaginary line 9 and the second imaginary line 81. The third imaginary line 9 is parallel with the imaginary axis 6 and in a position where it touches the first marginal line 7 for the last time when moved toward the spark gap G from a side of the spark gap G opposite to the joining end portion 44 of the ground electrode 4.

In order to evaluate the performance efficiency of the spark plug of this invention, the following measurements were made.

(1) Measurement of a variation of discharge voltage

In the examples of the spark plug P of this invention, the distance A and the spark gap G were varied variously as shown in Table 1 and the discharge voltage (kV) at the operation of each example of the spark plug P was measured under the condition that the spark plug P was mounted on a 3-liter, 6-cylinder engine and the engine was operated at A/F ratio of 18 and at idling for 10 minutes. From the measurement values, a standard deviation ($\sigma$) was obtained and a variation in discharge voltage was determined as 3 $\sigma$. The result of measurement is shown in Table 1. Further, when the spark gap G was set at 1.1 mm, a variation in discharge voltage in case the diameter of the center electrode tip 31 and the distance A in FIG. 3 were varied as shown in Table 2 was measured under the similar condition to that described above. The result is shown in Table 2. In the meantime, in Table 1, A=0.2 mm means that the end surface 42 of the ground electrode 4 is located on the right-hand side of the rightmost side surface portion of the center electrode tip 31 in FIG. 3 and A=−0.2 mm means that the rightmost side surface portion of the center electrode tip 31 is located more rightward than the end surface 42 of the ground electrode 4 in FIG. 3.

TABLE 1

| A (mm) | Variation of discharge voltage (kV) (G:0.7 mm) | (G:0.9 mm) | (G:1.1 mm) | (G:1.3 mm) |
|---|---|---|---|---|
| -0.02 | 8 | 13 | 11 | 12 |
| -0.01 | 9 | 10 | 12 | 13 |
| 0 | 7 | 8 | 10 | 9 |
| 0.01 | 4 | 6 | 6 | 8 |
| 0.02 | 3 | 3 | 8 | 7 |
| 0.03 | 3 | 2 | 2 | 6 |
| 0.04 | 2 | 2 | 3 | 3 |
| 0.05 | 2 | 2 | 2 | 2 |
| 0.06 | — | — | — | 2 |

TABLE 2

| Diameter of tip (mm) | Variation of discharge voltage (kV) (A:0.3 mm) | (A:0.4 mm) |
|---|---|---|
| 0.03 | 2 | 1 |
| 0.04 | 2 | 2 |
| 0.05 | 3 | 2 |
| 0.06 | 2 | 2 |
| 0.07 | 2 | 2 |
| 0.08 | 2 | 3 |
| 1.00 | 3 | 3 |
| 1.02 | 5 | 5 |
| 1.04 | 6 | 6 |

Figure 4:
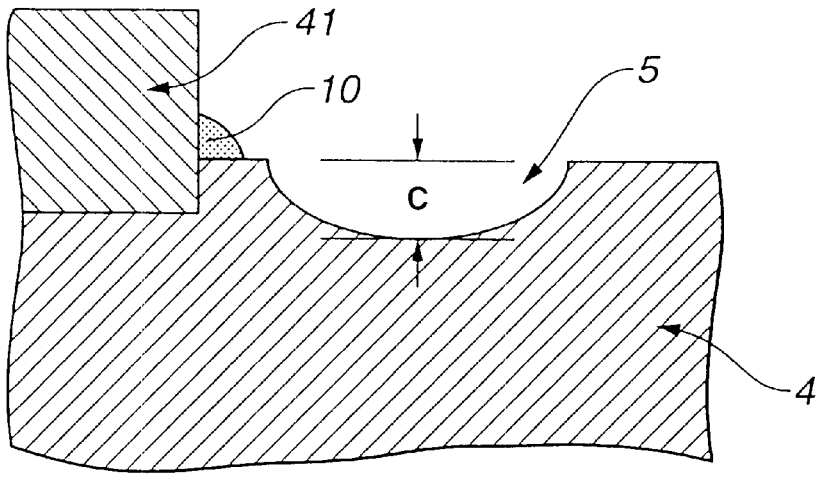
FIG. 4 is an enlarged sectional view of another portion of the spark plug of FIG. 1.
Figure 5:
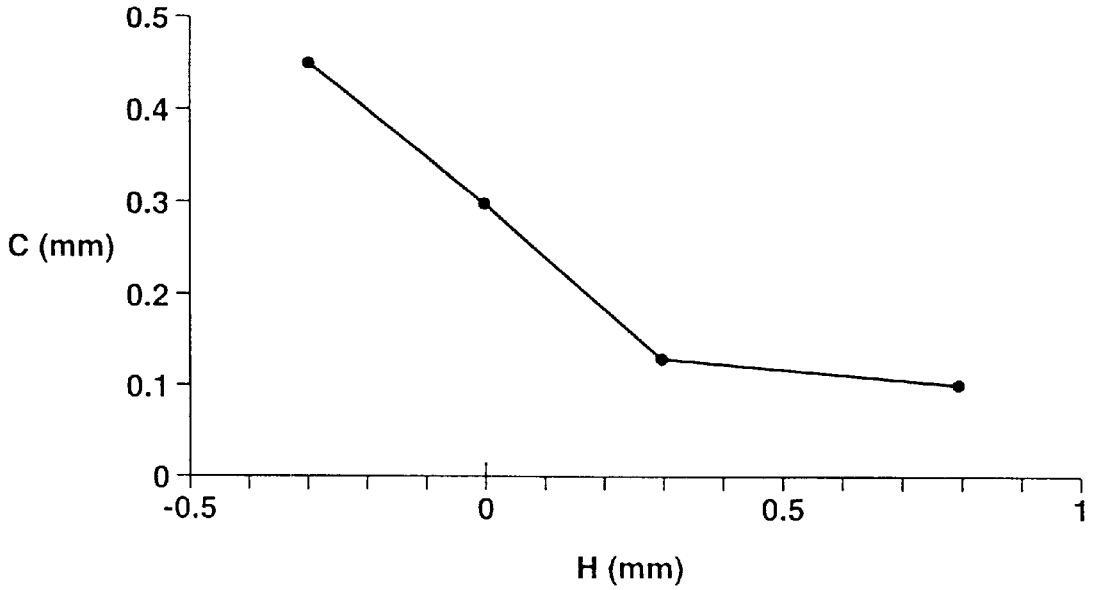
FIG. 5 is a graph of a relation between the distance H in FIG. 3 and the depth C in FIG. 4.
Figure 6:
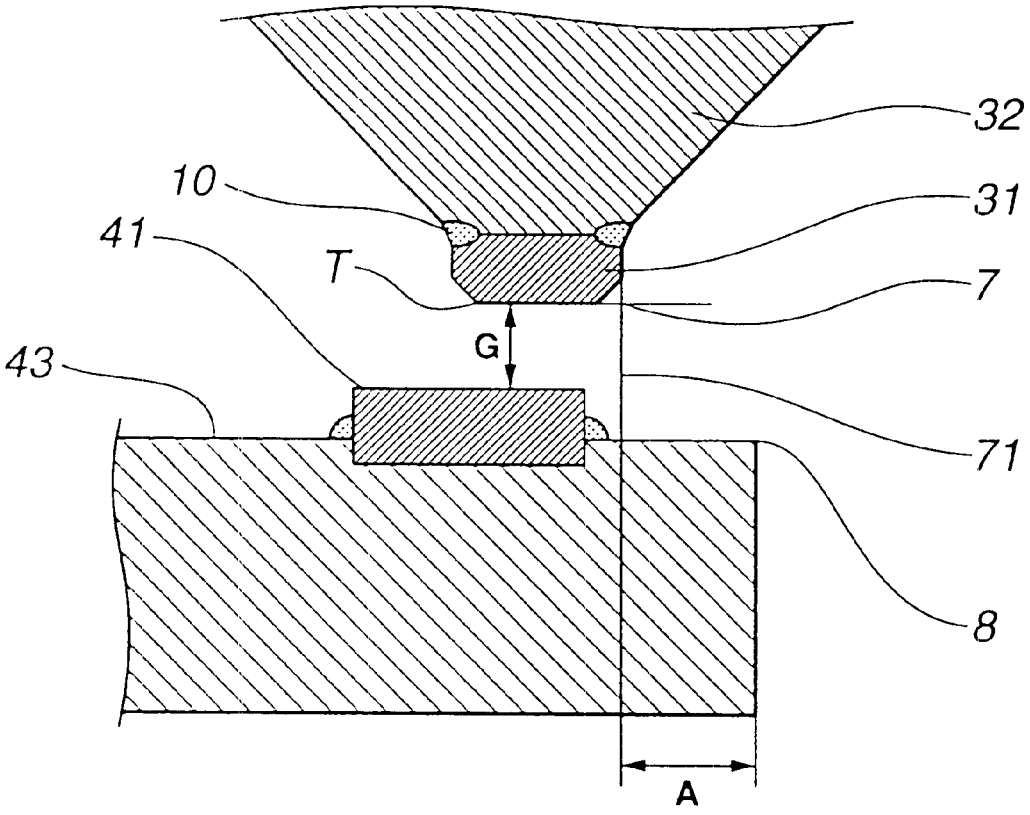
FIG. 6 is a view similar to FIG. 2 but shows another embodiment of the present invention.

(2) Measurement of a consumed portion at a discharge surface of a ground electrode By additional reference to FIG. 4, measurement of a maximum depth (C mm) of a consumed potion 5 caused at the discharge surface 43 of the ground electrode 4 was made under the following conditions. Namely, in the spark plug P of this invention, the distance A was set at 0.4 mm and the spark gap G was set at 0.9 mm. The distance H in FIG. 3 was changed to 0.8 mm, 0.3 mm, 0 mm and −0.3 mm, respectively. The spark plug was attached to a 2-liter engine. Measurement of the maximum depth (C mm) was made after operation of the engine at 6000 rpm and at full throttle (WOT) for 300 hours. In the meantime, the consumed portion 5 was located just below the axial end surface 311 of the center electrode tip 31. In this connection, in case the ground electrode tip 41 and the center electrode tip 31 are positioned so as to lie one upon another completely when viewed in plan, i.e., positioned coaxially, the consumed portion 5 was caused at the discharge surface of the ground electrode tip 41. The relation between the distance H and the maximum depth C is shown in FIG. 5. In the meantime, in FIG. 5, H=−0.3 means that the center electrode tip 31 and the ground electrode tip 41 are disposed so as not to lie one upon another when viewed in plan and the distance between the second imaginary line 81 and the third imaginary line 9 under such a condition is 0.3 mm.

(3) Evaluation based on the result of measurements

From Table 1, it will be seen that in case the distance A (mm) and the spark gap G (mm) satisfy $G \leqq 2A+0.5$ (in Table 1, the part lower than the dotted line), a variation in discharge voltage is small, i.e., 4 kV or smaller. In contrast to this, it will be seen that in case such a relational expression is not satisfied (in Table 1, the part higher than the dotted line), a variation in discharge voltage is remarkably increased, i.e., 6 kV or larger. Further, it will be seen from Table 2 that in case the distance A is set at a value ranging from 0.3 to 0.4 mm, a variation in discharge voltage is increased remarkably when the diameter of the center electrode tip 31 is 1.2 mm or larger. Further, it will be seen from FIG. 5 that in case the center electrode tip 31 is located just above the ground electrode tip 41 (H=0.8) the maximum depth C of the consumed portion 5 is small. In contrast to this, as the distance H decreases, i.e., the difference in position between the center electrode tip 31 and the ground electrode tip 41 increases, the maximum depth C of the consumed portion 5 increases. From this, it will be seen that an abnormal consumption is caused at the discharge surface 43 of the ground electrode 4.

From the foregoing, it will be understood that the spark plug of the present invention which has at an end surface of a center electrode a center electrode tip made of a material containing Ir as a major constituent and which has such a predetermined spark gap and such a predetermined positional relationship between an end surface of an outer electrode and the center electrode tip as described above, can makes it possible to elongate the life of the spark plug and can prevent a side spark and a variation of discharge voltage for thereby preventing emission of unburned gases.

Although the invention has been described above by reference to certain embodiments of the invention, the invention is not limited to the embodiments described above. Modifications and variations of the embodiments described above will occur to those skilled in the art, in light of the above teachings. For example, the present invention can be applied to various types of spark plugs other than that described and shown above. The scope of the invention is defined with reference to the following claims.

What is claimed is:

1. A spark plug comprising:

a metallic shell having an externally threaded portion;

an insulator disposed within the metallic shell and having an axial through hole;

a center electrode disposed within the axial through hole of the insulator; and a ground electrode having a joining end portion joined to the metallic shell and a free end portion having a discharge surface which is opposite to an axial end surface of the center electrode to provide therebetween a spark gap;

wherein the center electrode has a center electrode tip forming the axial end surface thereof, the center electrode tip being made of a material containing Ir as a major constituent; and wherein $G \leqq 2A+0.5$ where G is the spark gap in millimeter(s) and A is the distance in millimeter(s) between a first imaginary line and a second marginal line, the first imaginary line being parallel to an imaginary axis of the spark plug and in a position where it touches a first marginal line for the first time when moved toward the spark gap from a side of the spark gap opposite to the joining end portion along a plane including the imaginary axis and crossing the second marginal line at right angles, the imaginary axis being determined on the basis of an axis of the externally threaded portion, the first marginal line being formed by the axial end surface and a side surface of the center electrode tip, the second marginal line being formed by the discharge surface and an end surface of the free end portion of the ground electrode; and wherein the spark gap G ranges from 0.7 to 1.5 mm.

2. A spark plug according to claim 1, said spark plug having a vertical axis passing through the center of the externally threaded portion of the metallic shell, wherein the ground electrode has at the discharge surface thereof a ground electrode tip which is at least partially overlain by the center electrode tip when viewed in the direction of the vertical axis, and wherein a distance B between the second marginal line and a second imaginary line is equal to or larger than 0.2 mm, the second imaginary line being parallel to the second marginal line and in a position where it touches the ground electrode tip for the first time when moved along the discharge surface toward the ground electrode tip from a side of the ground electrode tip opposite to the joining end portion of the ground electrode.

3. A spark plug according to claim 2, wherein the distance B is equal to or larger than 0.3 mm.

4. A spark plug according to claim 2, wherein the distance B ranges from 0.35 to 0.8 mm.

5. A spark plug according to claim 1, wherein the center electrode tip is made of one selected from Ir—Pt alloy, Ir—Rh alloy and Ir—$Y_2O_3$ alloy.

6. A spark plug according to claim 1, wherein the diameter of the center electrode tip ranges from 0.3 to 1.0 mm.

7. A spark plug according to claim 6, wherein the diameter of the center electrode tip ranges from 0.4 to 0.8 mm.

8. A spark plug comprising:

a metallic shell having an externally threaded portion;

an insulator disposed within the metallic shell and having an axial through hole;

a center electrode disposed within the axial through hole of the insulator and having a center electrode tip; and a ground electrode having a joining end portion joined to the metallic shell and a free end portion having a discharge surface which is opposite to the center electrode tip to provide therebetween a spark gap;

wherein the center electrode tip is made of a material containing Ir as a major constituent; and wherein $G \leqq 2A+0.5$ where G is the spark gap in millimeter(s) and A is the distance in millimeter(s) between a first imaginary line and a second marginal line, the first imaginary line being parallel to an imaginary axis of the spark plug, located on a plane including the imaginary axis and crossing the second marginal line at right angles and on a side of the center electrode tip opposite to the joining end portion of the ground electrode, and touching a first marginal line which is formed by an axial end surface and a side surface of the center electrode tip, the imaginary axis being determined on the basis of an axis of the externally threaded portion of the metallic shell, the second marginal line being formed by the discharge surface and an end surface of the free end portion the ground electrode; and wherein the spark gap G ranges from 0.7 to 1.5 mm.

9. A spark plug according to claim 8, said spark plug having a vertical axis passing through the center of the externally threaded portion of the metallic shell, wherein the ground electrode has at the discharge surface thereof a ground electrode tip which is at least partially overlain by the center electrode tip when viewed in the direction of the vertical axis, and wherein a distance B between the second marginal line and a second imaginary line is equal to or larger than 0.2 mm, the second imaginary line being parallel to the second marginal line, located on the discharge surface of the ground electrode and on a side of the ground electrode tip opposite to the joining end portion of the ground electrode and touching the ground electrode tip.

10. A spark plug according to claim 9, wherein the distance B is equal to or larger than 0.3 mm.

11. A spark plug according to claim 9, wherein the distance B ranges from 0.35 to 0.8 mm.

12. A spark plug according to claim 8, wherein the center electrode tip is made of one selected from Ir—Pt alloy, Ir—Rh alloy and Ir—$Y_2O_3$ alloy.

13. A spark plug according to claim 8, wherein the diameter of the center electrode tip ranges from 0.3 to 1.0 mm.

14. A spark plug according to claim 13, wherein the diameter of the center electrode tip ranges from 0.4 to 0.8 mm.

* * * * *